US008303343B2

(12) United States Patent
Nagata

(10) Patent No.: US 8,303,343 B2
(45) Date of Patent: Nov. 6, 2012

(54) MULTIPOLAR PLUG

(75) Inventor: Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/963,903

(22) Filed: Dec. 9, 2010

(65) Prior Publication Data

US 2011/0143594 A1 Jun. 16, 2011

(30) Foreign Application Priority Data

Dec. 11, 2009 (JP) ..... 2009-281946

(51) Int. Cl.
*H01R 13/648* (2006.01)

(52) U.S. Cl. ..... 439/607.54

(58) Field of Classification Search ..... 439/607.01, 439/607.54, 638, 639, 660, 630, 692
See application file for complete search history.

(56) References Cited

U.S. PATENT DOCUMENTS

| | | | |
|---|---|---|---|
| 7,422,488 | B1 | 9/2008 | Wu |
| 7,614,920 | B1 | 11/2009 | Yi |
| 2008/0050950 | A1 | 2/2008 | Wu |
| 2009/0156027 | A1 | 6/2009 | Chen |

FOREIGN PATENT DOCUMENTS

| | | |
|---|---|---|
| JP | 2007-103249 | 4/2007 |

*Primary Examiner* — Alexander Gilman
(74) *Attorney, Agent, or Firm* — Rankin, Hill & Clark LLP

(57) ABSTRACT

When a multipolar plug and a counter connector are fitted to each other, there is a possibility that a seam joint of a shell of the multipolar plug may coincide with that of a shell the counter connector, and high-frequency noises may leak through gaps of the coincident seam joints. The invention has been conducted in view of the problem, and provides a multipolar plug which can improve the EMI characteristics of a multipolar connector. According to the invention, when the multipolar plug 2 and the counter connector 4 are fitted to each other, the seam joint 9*a* of the shell 9 of the multipolar plug 2 is shifted from a seam joint 17*a* of a shell 17 of the counter connector 4.

4 Claims, 14 Drawing Sheets

MULTIPOLAR PLUG

TECHNICAL FIELD

The present invention relates to a multipolar plug comprising a shield which functions as a countermeasure against EMI (ElectroMagnetic Interference).

BACKGROUND ART

Conventionally, there is a countermeasure against EMI (hereinafter, referred to as "EMI countermeasure") for a multipolar connector. In the EMI countermeasure, a shell of a cable-side connector which is configured as a multi-polar male connector (multipolar plug), and that of a board mounted (apparatus-side) connector which is configured as a multipolar female connector (multipolar receptacle) functioning as a fitting counter are used for covering circumferences of fitting portions of the connectors, and formed by metal plates to have a shielding property, respectively. When the cable-side connector and the board mounted connector are fitted to each other, the shells are electrically coupled to each other. In order to reduce the cost and size of the multipolar connector, each of the shells is formed into a tubular shape by applying a pressing process such as a punching process or a bending process on a metal plate. Therefore, the shell has a seam joint which is formed with being centered at the center line so that the strength balance of the shell is maintained (see. Literature 1).

PRIOR ART LITERATURE

Patent Literature

[Patent Literature 1] Japanese Patent Application Laid-Open No. 2007-103249

SUMMARY OF THE INVENTION

Problems to be Solved by the Invention

In the above-described conventional art, when the cable-side connector and the board mounted connector are fitted to each other, there is a possibility that the seam joints of the shells may coincide with each other, and high-frequency noises may leak through gaps of the coincident seam joints.

The invention has been conducted in view of above-discussed problem. It is an object of the invention to provide a multipolar plug which can improve the EMI characteristics of a multipolar connector.

Means for Solving the Problems

In order to solve the above-discussed problem, according to the invention, in a multipolar plug in which a tubular shell that is a cover for a circumference of a fitting portion for a counter connector is formed by applying a bending process on a metal plate, thereby providing the shell with a shielding property, and the shell has a seam joint, the seam joint is disposed in a position which is biased to one side of a center line of the shell. According to the configuration, when the multipolar plug and the counter connector are fitted to each other, seam joints of the shells are shifted from each other. Therefore, high-frequency noises hardly leak, and the EMI characteristics of a multipolar connector can be improved.

In the counter connector, a tubular shell which is a cover for a circumference of a fitting portion for the multipolar plug is formed by applying a bending process on a metal plate, thereby providing the sell with a shielding property, and the shell has a seam joint. Similarly with the conventional art, the seam joint can be disposed with being centered at the center line of the shell. In the counter connector, therefore, the strength of the shell against prying caused by the multipolar plug is not reduced.

According to the invention, a configuration may be employed where an engagement portion for the counter connector is formed in one face of the shell of the multipolar plug, and the seam joint is disposed in a face opposite to the one face of the shell in which the engagement portion is formed. Therefore, it is possible to easily cope with miniaturization of a multipolar connector.

According to the invention, a configuration may be employed where a plurality of contacts which are attached to a body made of an insulating material, and which are included in the shell of the multipolar plug contain a plurality of contact pairs for transmitting high-speed differential signals, and the seam joint is disposed outside a region where the plurality of contact pairs are arranged. Therefore, the seam joint of the shell of the multipolar plug is, shifted from a line (the contact pairs) for transmitting high-speed differential signals. Consequently, high-frequency noises more hardly leak, and the EMI characteristics of a multipolar connector can be further improved.

According to the invention, a configuration may be employed where a tubular back shell that is a cover for a portion to which a cable is to be connected is disposed, the back shell is formed by a metal plate, thereby providing the shell with a shielding property, and the shell, the back shell, and a shield of the cable are electrically coupled to one another. In the case where the multipolar plug is configured as a cable-side connector, therefore, it is possible to configure a shield having excellent EMI characteristics.

Effect of the Invention

According to the invention, it is possible to provide a multipolar plug which can improve the EMI characteristics of a multipolar connector.

MODE FOR CARRYING OUT THE INVENTION

Hereinafter, an embodiment of the invention will be described with reference to the drawings. In the embodiment, the invention will be described with reference to a multipolar connector for connecting a cable for a high-speed interface through which electric/electronic apparatuses are connected with each other, with an electric/electronic apparatus. As shown in FIGS. 10 to 14, the multipolar connector is configured by: a cable-side connector (the multipolar plug of the invention) 2 which is configured as a shielded multipolar male connector that is to be disposed in an end of a shielded composite cable (an example of a cable) 1 wherein lines for the power supply, video, audio, control, and the like are bundled; and a board mounted (apparatus-side) connector (a counter connector of the multipolar plug of the invention, a multipolar receptacle) 4 which is configured as a shielded multipolar female connector that is to be mounted on an edge of a board (printed circuit board) 3 of a digital camera or a portable telephone (an example of the electric/electronic apparatus).

Figure 1B:
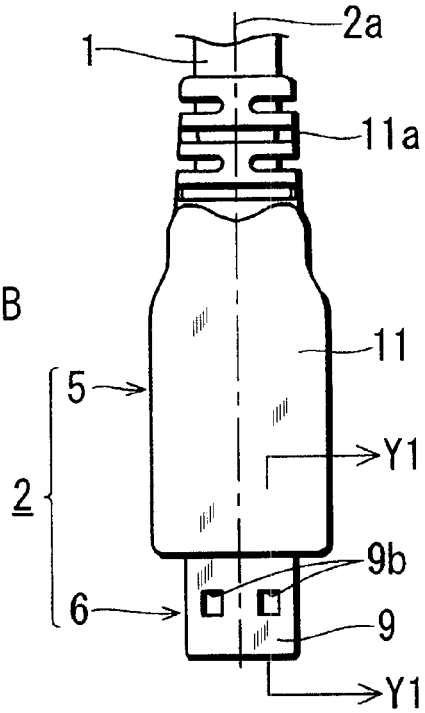
FIG. 1 shows a front view (FIG. 1A) of a cable-side connector of an embodiment of the invention, a plan view (FIG. 1B), a bottom view (FIG. 1C), and a right side view (FIG. 1D).
Figure 1A:
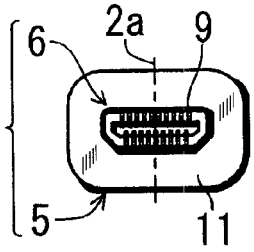
Figure 1D:
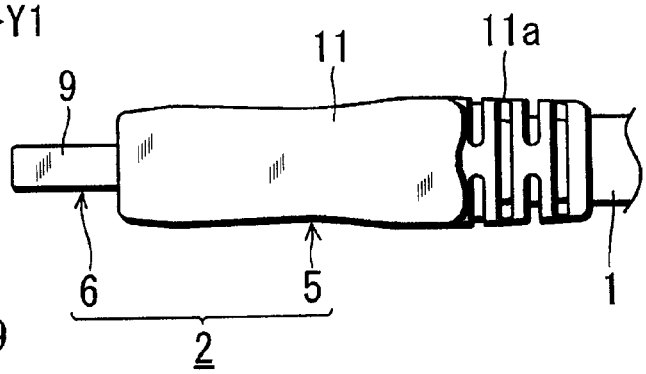
Figure 1C:
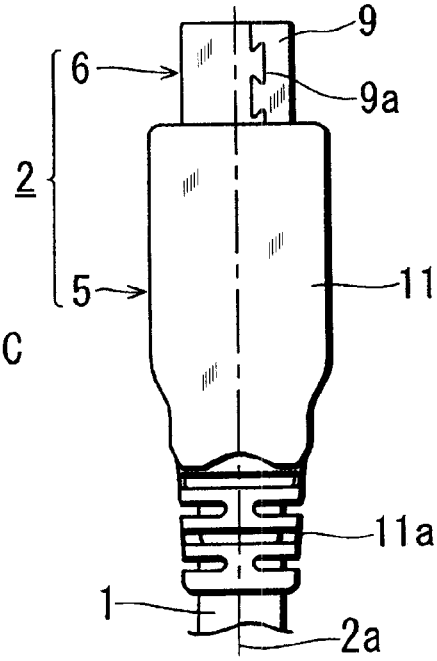
Figure 2:
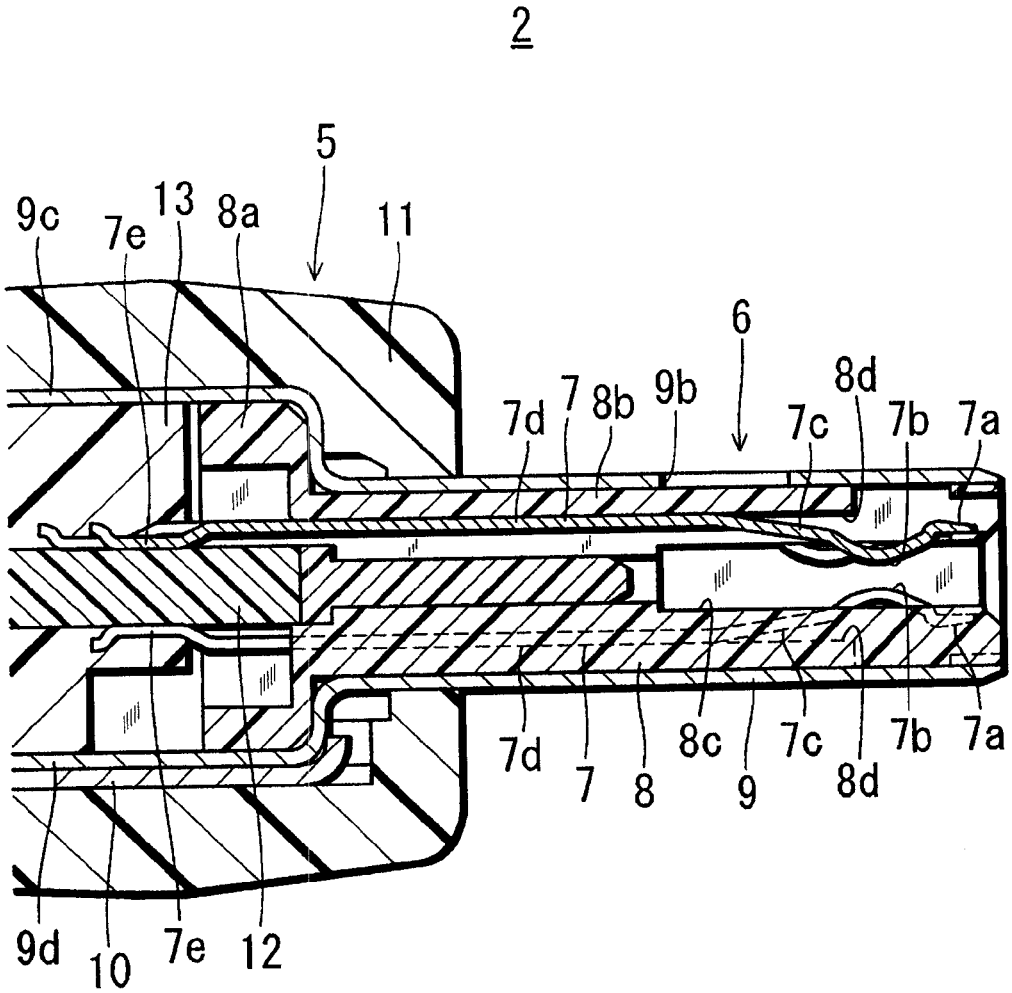
FIG. 2 is a sectional view of the cable-side connector shown in FIG. 1, taken along Y1-Y1 (FIG. 1B).
Figure 3:
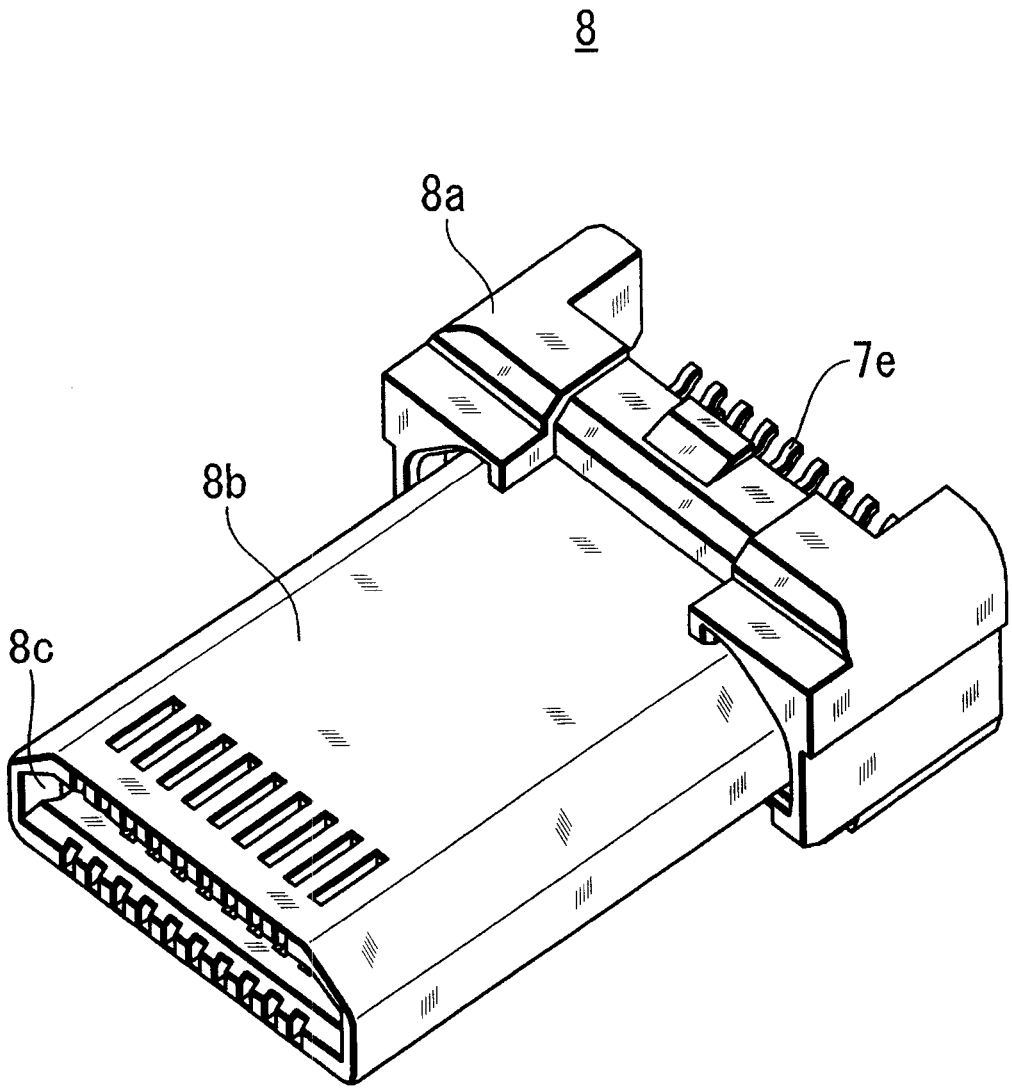
FIG. 3 is a perspective view of the body of the cable-side connector shown in FIG. 1.
Figure 4:
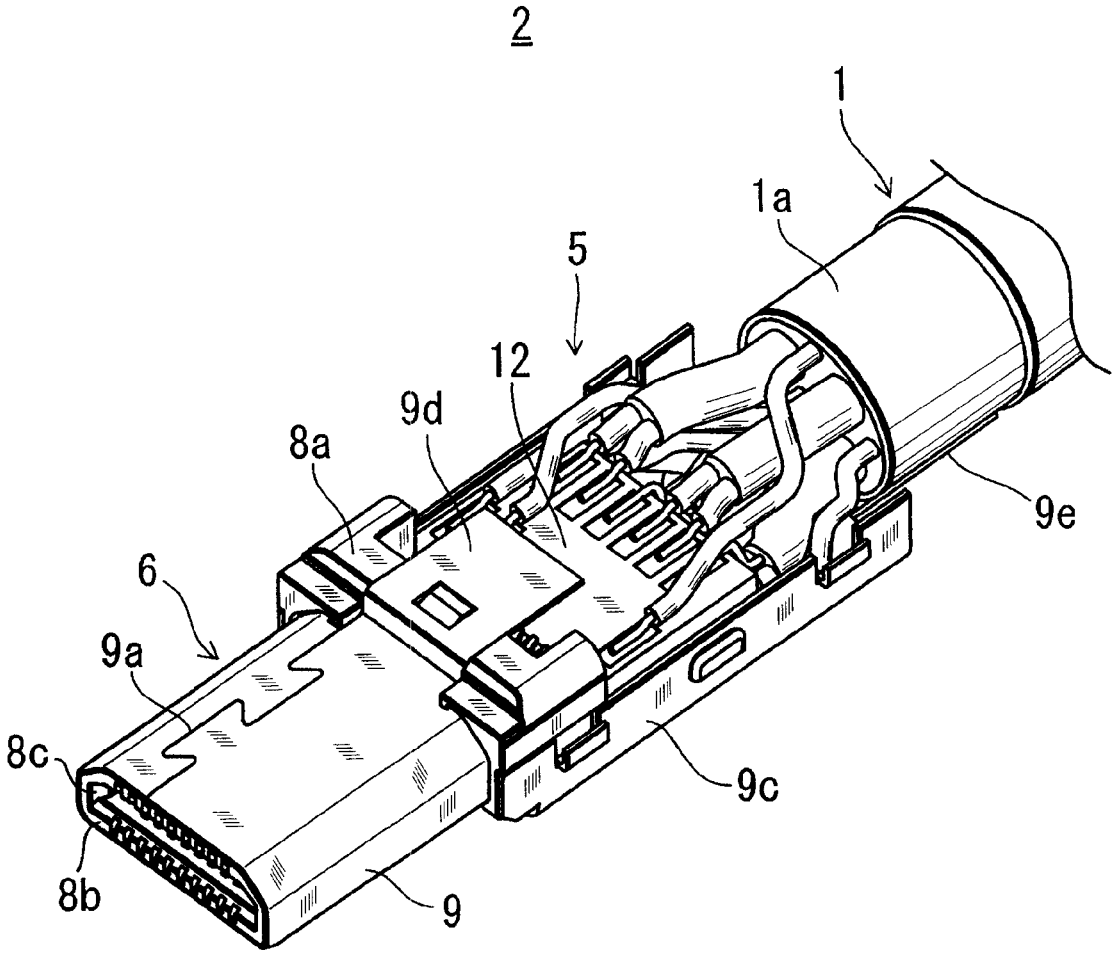
FIG. 4 is a perspective view of the cable-side connector shown in FIG. 1 in a state where a hood and a back shell cover are removed.
Figure 5:
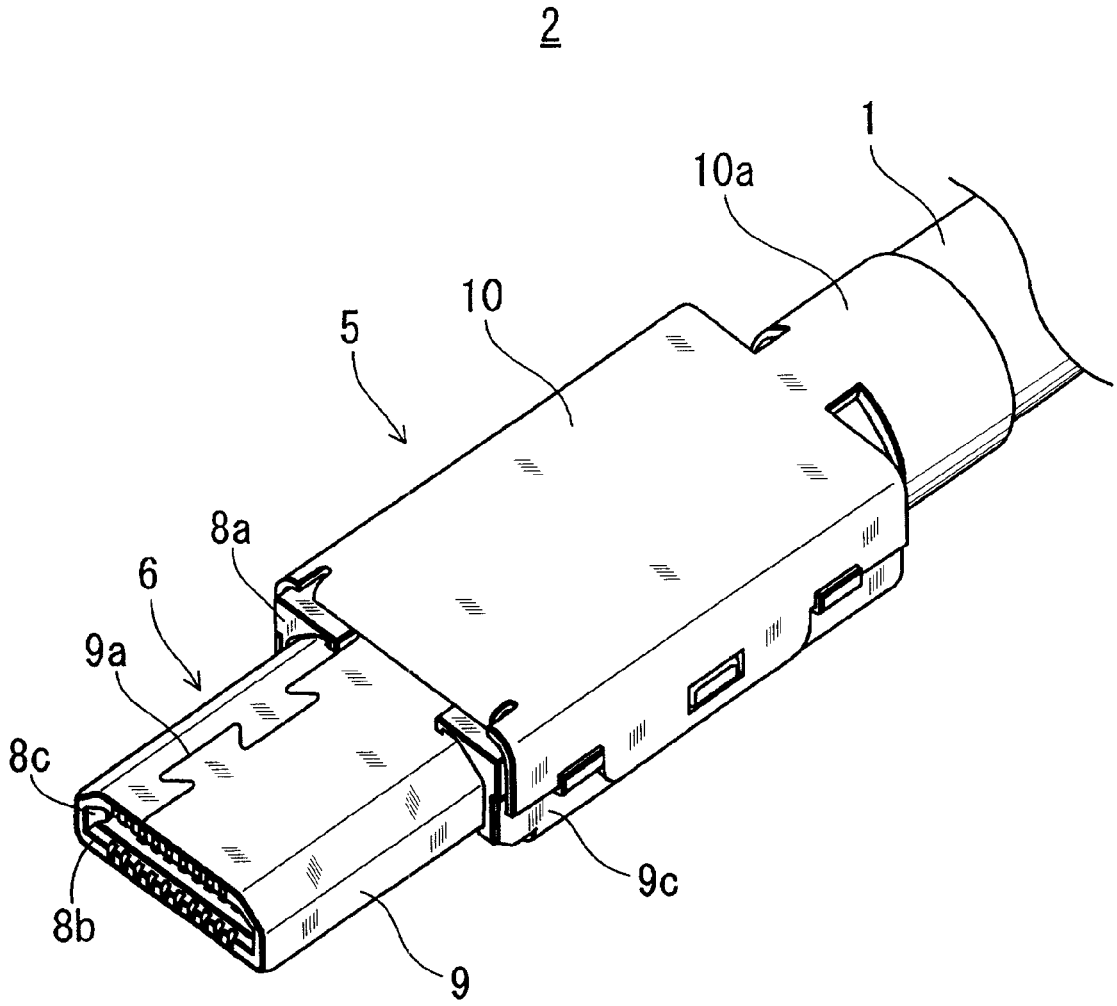
FIG. 5 is a perspective view of the cable-side connector shown in FIG. 1 in a state where the hood is removed.
Figure 6:
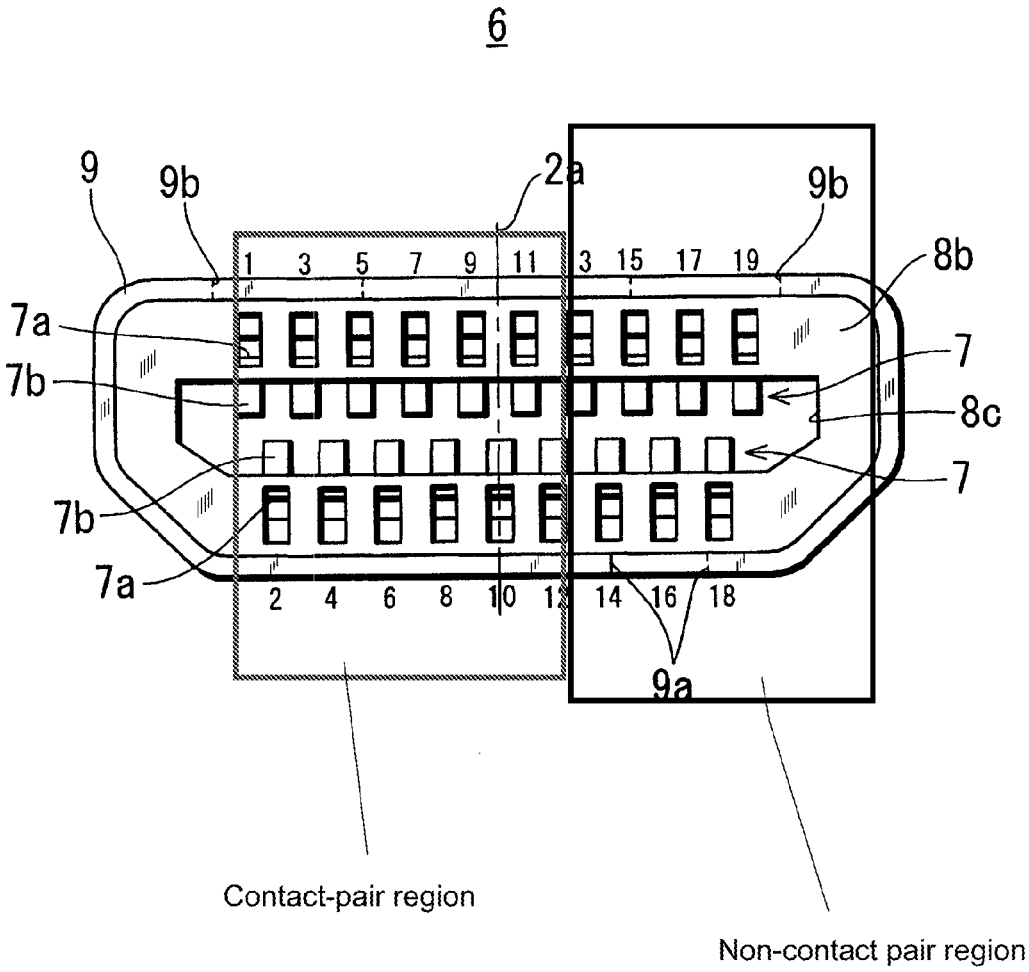
FIG. 6 is an enlarged front view of a fitting portion of the cable-side connector shown in FIG. 1.

First, the cable-side connector 2 will be described with reference to FIGS. 1 to 6. FIG. 1 is an external view of the cable-side connector 2 of the embodiment of the invention, FIG. 1A is a front view of the cable-side connector 2, FIG. 1B is a plan view of the cable-side connector 2, FIG. 1C is a bottom view of the cable-side connector 2, and FIG. 1D is a right side view of the cable-side connector 2. FIG. 2 is a sectional view of the cable-side connector 2 shown in FIG. 1B, taken along Y1-Y1, FIG. 3 is a perspective view of the body 8 of the cable-side connector 2 shown in FIG. 1B, as viewed from an obliquely upper side, FIG. 4 is a perspective view of the cable-side connector 2 shown in FIG. 1B in a state where a hood 11 and a back shell cover 10 are removed, as viewed from an obliquely upper side, FIG. 5 is a perspective view of the cable-side connector 2 shown in FIG. 1B in a state where the hood 11 is removed, as viewed from an obliquely upper side, and FIG. 6 is an enlarged view of a fitting portion 6 of the cable-side connector 2 shown in FIG. 1A.

As shown in FIGS. 1A to 1D, the cable-side connector 2 has a connecting portion 5 with respect to the cable 1, and the fitting portion 6 which is a connecting portion with respect to the board mounted connector 4. The dash-dot chain line 2*a* in FIGS. 1A to 1C indicates the center line of the connecting portion 5 and fitting portion 6 of the cable-side connector 2, i.e., the center line of the cable-side connector 2.

As shown in FIGS. 2 to 6, the cable-side connector 2 is mainly configured by nineteen (an example of plurality) contacts 7, the body 8, a shell (front shell) 9, the back shell cover 10, and the hood 11.

As shown in FIG. 2, each of the contacts 7 is configured by a slender electrode terminal which is formed by applying a pressing process such as a punching process or a bending process on a metal plate, and which is elongated in the anteroposterior direction, and is electrically conductive. In the contact 7, an engagement portion 7*a* for applying preload, a movable contact portion 7*b* having a mountain-like shape, a spring portion 7*c* for urging a contact, and a fixed portion 7*d* are formed in this sequence in the direction from the front end to the rear side. A soldering portion 7*e* is formed in a rear end portion of the contact 7.

As shown in FIGS. 2, 3, and 6, the body 8 is made of an insulating material such as plastic, and is electrically insulative. In the body 8, a parallelepiped-like contact support basal portion 8*a*, and a rectangular tubular contact support portion 8*b* which is projected from the middle of the front face of the contact support basal portion 8*a* in the forward direction (the direction along which the cable-side connector 2 is inserted to the board mounted connector 4) are formed. A counter contact insertion hole 8*c* which opens in the front face is formed by a front portion of the contact support portion 8*b*. In the upper and lower opposite side walls of the contact support portion 8*b*, ten contact housing grooves 8*d* which are laterally arranged in one row, and which extend in parallel in the anteroposterior direction are formed on the inner surface of the upper side wall, and nine contact housing grooves 8*d* which are laterally arranged in one row, and which extend in parallel in the anteroposterior direction are formed on the inner surface of the lower side wall. The upper contact housing grooves 8*d* and the lower contact housing grooves 8*d* are arranged in a zigzag manner so as not to overlap with each other in a plan view.

In the nineteen contacts 7, ten contacts 7 are press inserted into the upper contact housing grooves 8*d* so as to be attached to the upper side wall of the contact support portion 8*b* while being laterally arranged in one row and extending in parallel in the anteroposterior direction. In each of the ten contacts 7, in this attached state, the fixed portion 7*d* is press inserted and fixed to a rear portion of the upper contact housing groove 8*d*, and the spring portion 7*c*, contact portion 7*b*, and engagement portion 7*a* which are in front of the fixed portion 7*d* are inserted and housed into a front portion of the upper contact housing groove 8*d* so as to be vertically elastically displaceable. At this time, by a downward urging force of the spring portion 7*c*, the engagement portion 7*a* is engaged from the upper side with the upper side wall of the contact support portion 8*b* in slightly front of the free return position of the spring portion 7*c*, and, in a state where a preload is applied to the movable contact portion 7*b*, the movable contact portion 7*b* is downward projected from the front portion of the contact housing groove 8*d* into an upper portion of the counter contact insertion hole 8*c*, and held therein. The soldering portion 7*e* is projected to the rear side of the body 8.

The remaining nine contacts 7 are press inserted into the lower contact housing grooves 8*d* so as to be attached to the lower side wall of the contact support portion 8*b* while being laterally arranged in one row and extending in parallel in the anteroposterior direction. In each of the nine contacts 7, in this attached state, the fixed portion 7*d* is press inserted and fixed to a rear portion of the lower contact housing groove 8*d*, and the spring portion 7*c*, movable contact portion 7*b*, and engagement portion 7*a* which are in front of the fixed portion 7*d* are inserted and housed into a front portion of the lower contact housing groove 8*d* so as to be vertically elastically displaceable. At this time, by an upward urging force of the spring portion 7*c*, the engagement portion 7*a* is engaged from the lower side with the lower side wall of the contact support portion 8*b* in slightly front of the free return position of the spring portion 7*c*, and, in a state where a preload is applied to the movable contact portion 7*b*, the movable contact portion 7*b* is upward projected from the front portion of the contact housing groove 8*d* into a lower portion of the counter contact insertion hole 8*c*, and held therein. The soldering portion 7*e* is projected to the rear side of the body 8.

In this way, the nineteen contacts 7 are attached and held to the body 8, arranged in the two upper and lower rows, and arranged in a zigzag manner so that the upper contacts 7 do not overlap with the lower contacts 7 in a plan view.

As shown in FIGS. 2, 4, and 5, the shell 9 is configured by a rectangular metal-made tube which is formed by applying a pressing process such as a punching process or a bending process on a single metal plate, and which is elongated in the anteroposterior direction, and is electrically conductive. As shown also in FIGS. 1A to 1C, the rectangular tubular shape of the shell 9 is formed by joining the right and left edges of a rectangular metal plate (the shell 9 in a development state) to each other in the lower side of the shell 9, without being centered at the center line 2*a* of the shell 9, and in a position which is biased toward the right side (an example of one side) from the center line 2*a* of the shell 9. In the shell 9 having a rectangular tubular shape, therefore, the lower side plate is formed by the right and left end portions of the rectangular metal plate, and a seam joint 9*a* between the right and left end portions of the rectangular metal plate is disposed in the lower side plate of the shell 9, and in the position which is biased toward the right side from the center line 2*a* the shell 9. The shape of the seam joint 9*a* is not linear, but formed into a convex and concave shape in which inverted trapezoidal convex concave portions are alternately continuous to one another.

Then, the shell 9 is fitted onto the contact support portion 8*b* of the body 8 to which the nineteen contacts 7 are internally attached and held, to cover the outer surface of the contact support portion 8*b*.

In this way, the fitting portion 6 of the cable-side connector 2 is configured by the contact support portion 8*b* of the body 8 to which the nineteen contacts 7 are internally attached and held, and in which the outer surface is covered by the metal-made shell 9 having a shielding property. In the fitting portion 6, therefore, the seam joint 9*a* of the shell 9 is disposed in the lower surface, and in the position which is biased toward the right side from the center line 2*a* of the fitting portion 6.

In order to enhance the pull-out force required to pull the cable-side connector 2 out of the board mounted connector 4 to improve the fitting reliability of the multipolar connector, a cutaway window 9*b* which functions as an engagement portion with respect to the board mounted connector 4 is disposed in the upper side plate of the shell 9. The cutaway window 9*b* is disposed in each of two places which are bilaterally symmetric while setting the center line 2*a* of the shell 9 as the axis of symmetry. In the fitting portion 6, the cutaway windows 9*b* which function as an engagement portion with respect to the board mounted connector 4 are disposed in the upper surface, and in the two places which are bilaterally symmetric while setting the center line 2*a* of the fitting portion 6 as the axis of symmetry.

In this way, the seam joint 9*a* of the shell 9 is disposed in the face (lower face) opposite to the one face (upper face) of the shell 9 in which the cutaway windows 9*b* functioning as an engagement portion with respect to the board mounted connector 4 are disposed.

In rear of the shell 9, moreover, a back shell body 9*c* having a U-like section shape which downward opens, and a positioning plate 9*d* are disposed. The back shell body 9*c* is formed integrally with the shell 9 by an extension portion of the upper side plate of the shell 9. The positioning plate 9*d* is formed integrally with the shell 9 by an extension portion of the lower side plate which is on the left side with respect to the seam joint 9*a* of the shell 9, and which has a large lateral width.

The back shell cover 10 is formed by applying a pressing process such as a punching process or a bending process on a single metal plate, and is electrically conductive. The back shell cover has a U-like section shape which upward opens, so as to cover the back shell body 9*c*.

The back shell body 9*c*, and the back shell cover 10 which covers the back shell body 9*c* from the lower side configure a rectangular tubular back shell which is integrated with the shell 9, which is elongated in the anteroposterior direction in rear of the shell 9, which is made of a metal, and which has a shielding property.

In the back shell body 9*c* and the back shell cover 10, when the back shell cover 10 covers the back shell body 9*c*, their left side plates overlap with each other, and their right side plates overlap with each other. Therefore, the back shell body 9*c* and the back shell cover 10 are electrically coupled with each other, and coupled and integrated with each other by the convex-concave fitting of the overlapping side plates. The contact support basal portion 8*a* of the body 8 is internally fitted to a front portion of the back shell, and the outer surface of the contact support basal portion 8*a* of the body 8 is covered by the front portion of the back shell. When the contact support basal portion 8*a* of the body 8 is internally fitted to the front portion of the back shell, the positioning plate 9*d* overlaps with the lower surface of the contact support basal portion 8*a*. By the convex-concave fitting between the lower surface of the contact support basal portion 8*a* and positioning plate 9*d* which overlap with each other, the body 8 and the shell 9 are positioned with respect to the back shell in the anteroposterior direction.

In rear of the back shell, a cable shield contact piece 9*e* which is formed by an extension portion of the upper side plate of the back shell body 9*c*, and a cable crimping piece 10*a* which is formed by an extension portion of the lower side plate of the back shell cover 10 are disposed.

The cable-sidle connector 2 comprises a board 12 which is used for electrical connection with the cable 1, and which is configured by a printed circuit board. The soldering portions 7*e* of the upper contacts 7 which are projected to the rear side of the body 8 are soldered to the upper surface of a front end portion of the board 12, and the soldering portions 7*e* of the lower contacts 7 which are projected to the rear side of the body 8 are soldered to the lower surface of the front end portion of the board 12. On the other hand, the ends of the core lines for the power supply, video, audio, control, and the like in the cable 1 are distributedly soldered to the upper and lower surfaces of the board 12, and the nineteen contacts 7 are electrically connected with the core lines for the power supply, video, audio, control, and the like in the cable 1 in the rear side of the body 8, respectively.

The cable 1 comprises a cable shield 1*a* located inside a sheath. In a state where the cable shield 1*a* which is exposed by a peeling process applied on the sheath in the end of the cable 1 is contacted with the cable shield contact piece 9*e*, and the cable crimping piece 10*a* embraces the cable shield contact piece 9*e* from the upper side of the cable shield 1*a*, the piece is crimped and fixed to the end of the cable 1, whereby the shield of the cable-side connector 2, i.e., the shell 9 and the back shell, and the cable shield 1*a* are electrically connected to each other, and the back shell of the cable-side connector 2 is joined to the end of the cable 1.

Then, the soldering portions 7*e* of all the contacts 7, the board 12, and the ends of the core lines for the power supply, video, audio, control, and the like in the cable 1 are integrally enclosed and sealed by an insulating material such as plastic by means of inner mold. As a result of this sealing, a parallelepiped-like back body 13 which is in series placed in rear of the body 8 is formed. The back body 13 is internally fitted together with the contact support basal portion 8*a* of the body 8 to the back shell, and the outer surface of the contact support basal portion 8*a* of the body 8, and that of the back body 13 are integrally covered by the back shell. Furthermore, the back shell is enclosed and sealed by an insulating material such as plastic by means of inner mold. As a result of this sealing, the hood 11 having a long parallelepiped shape is formed.

Therefore, the connecting portion 5 which functions as a holding portion of the cable-side connector 2, and which is to be connected to the cable 1 is configured in rear of the fitting portion 6 of the cable-side connector 2 by: the back body 13 in which the soldering portions 7*e* of all the contacts 7, the board 12, and the ends of the lines for the power supply, video, audio, control, and the like in the cable 1 are integrally enclosed and sealed; the contact support basal portion 8*a* of the body 8; the back shell into which the back body 13 and the contact support basal portion 8*a* of the body 8 are internally fitted, and the outer surface of the back body 13, and that of the contact support basal portion 8*a* of the body 8 are integrally covered, which is made of a metal, and which has a shielding property; and the hood 11 which embraces and seals the back shell. As a result, the cable-side connector 2 is completed. The hood 11 exceeds the crimping portion of the cable 1 to cover an end portion of the sheath which is not peeled. A cable bush 11*a* for preventing the cable 1 from being bent is formed in a rear end portion of the hood 11 which covers the end portion of the sheath.

The nineteen contacts 7 of the cable-side connector 2 include a plurality of contact pairs for transmitting high-speed differential signals, and contacts for electrical connection other than transmission of high-speed differential signals. For the sake of convenience, the nineteen contacts 7 are provided with contact numbers as shown in FIG. 6. Then, two adjacent contacts 7 Nos. 1 and 3, two adjacent contacts 7 Nos. 4 and 6, two adjacent contacts 7 Nos. 7 and 9, and two adjacent contacts 7 Nos. 10 and 12 constitute the contact pairs for transmitting high-speed differential signals, respectively. As described above, the four contact pairs for transmitting high-speed differential signals are arranged while being biased toward the right side. As shown in FIG. 6, therefore, the seam joint 9*a* of the shell 9 is disposed in a position which is biased to the left side of the center line 2*a* of the shell 9. Namely, the direction and distance by which the seam joint 9*a* is biased to one side of the center line 2*a* of the shell 9 are set so that the seam joint 9*a* separates from the contact pairs for transmitting high-speed differential signals, and the seam joint 9*a* do not overlap with the contact pairs for transmitting high-speed differential signals in a plan view.

In this way, the seam joint 9*a* of the shell 9 is disposed outside the region where the four contact pairs for transmitting high-speed differential signals are arranged.

Figure 7B:
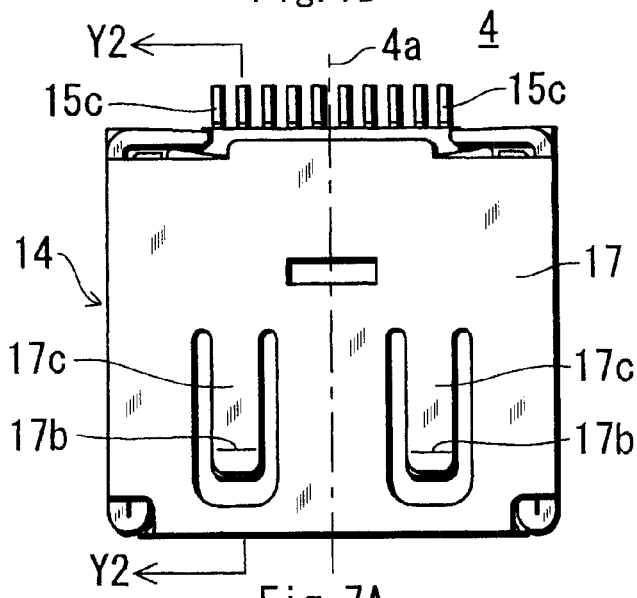
FIG. 7 shows a front view (FIG. 7A) of a board mounted connector of the embodiment of the invention, a plan view (FIG. 7B), a bottom view (FIG. 7C), and a left side view (FIG. 7D).
Figure 7D:
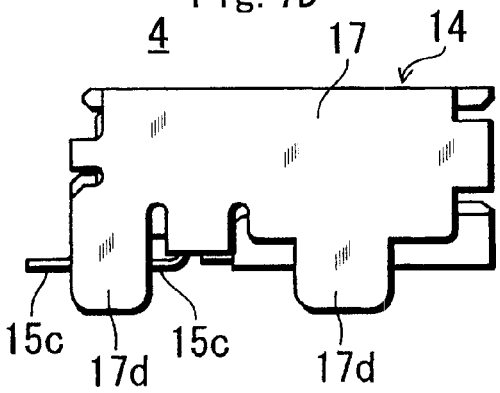
Figure 7A:
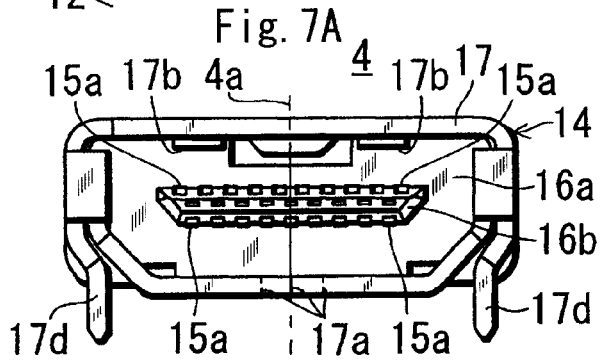
Figure 7C:
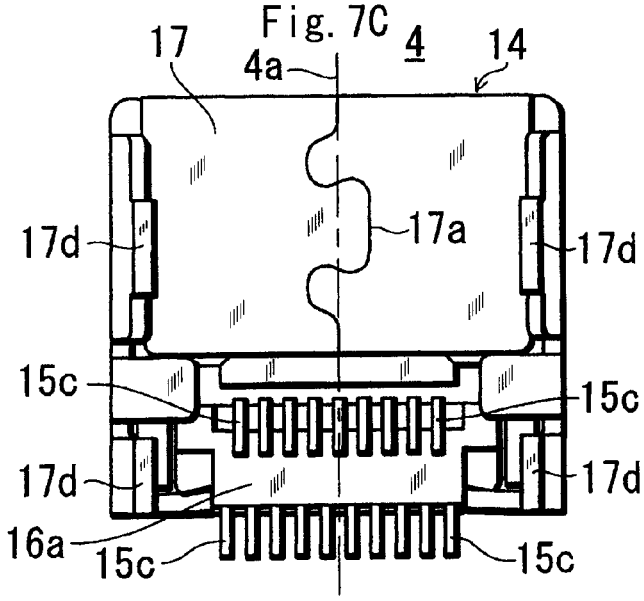
Figure 8:
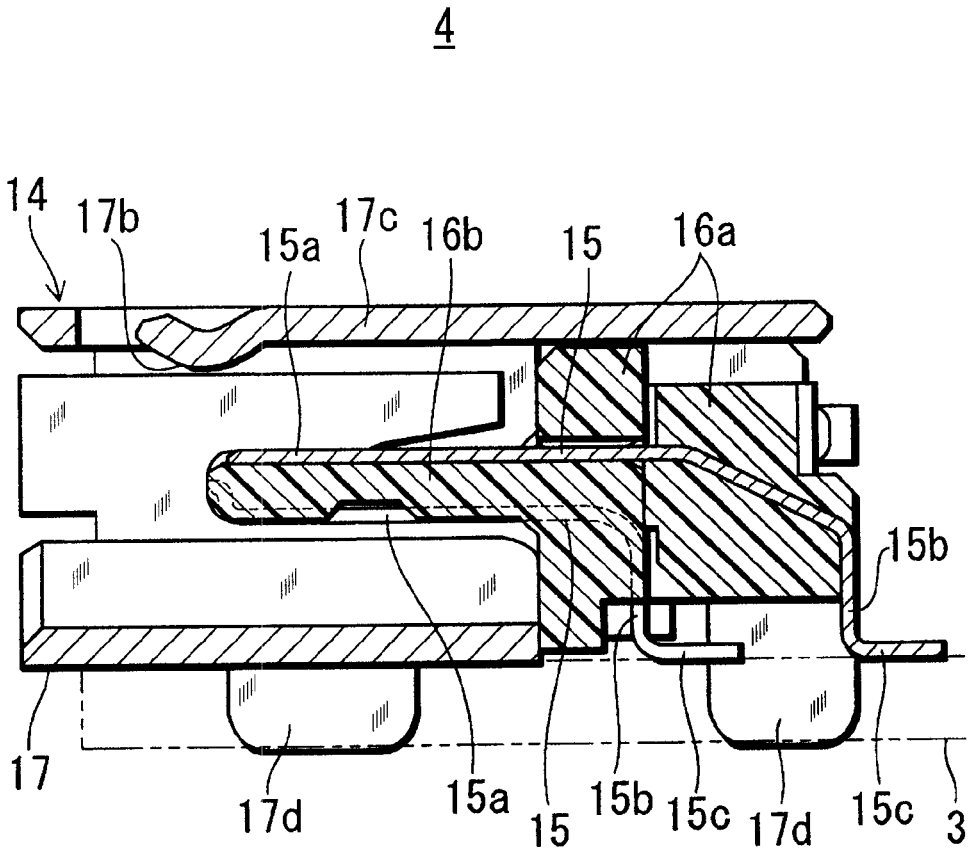
FIG. 8 is a sectional view taken of the board mounted connector shown in FIG. 7, along Y2-Y2 (FIG. 7B).
Figure 9:
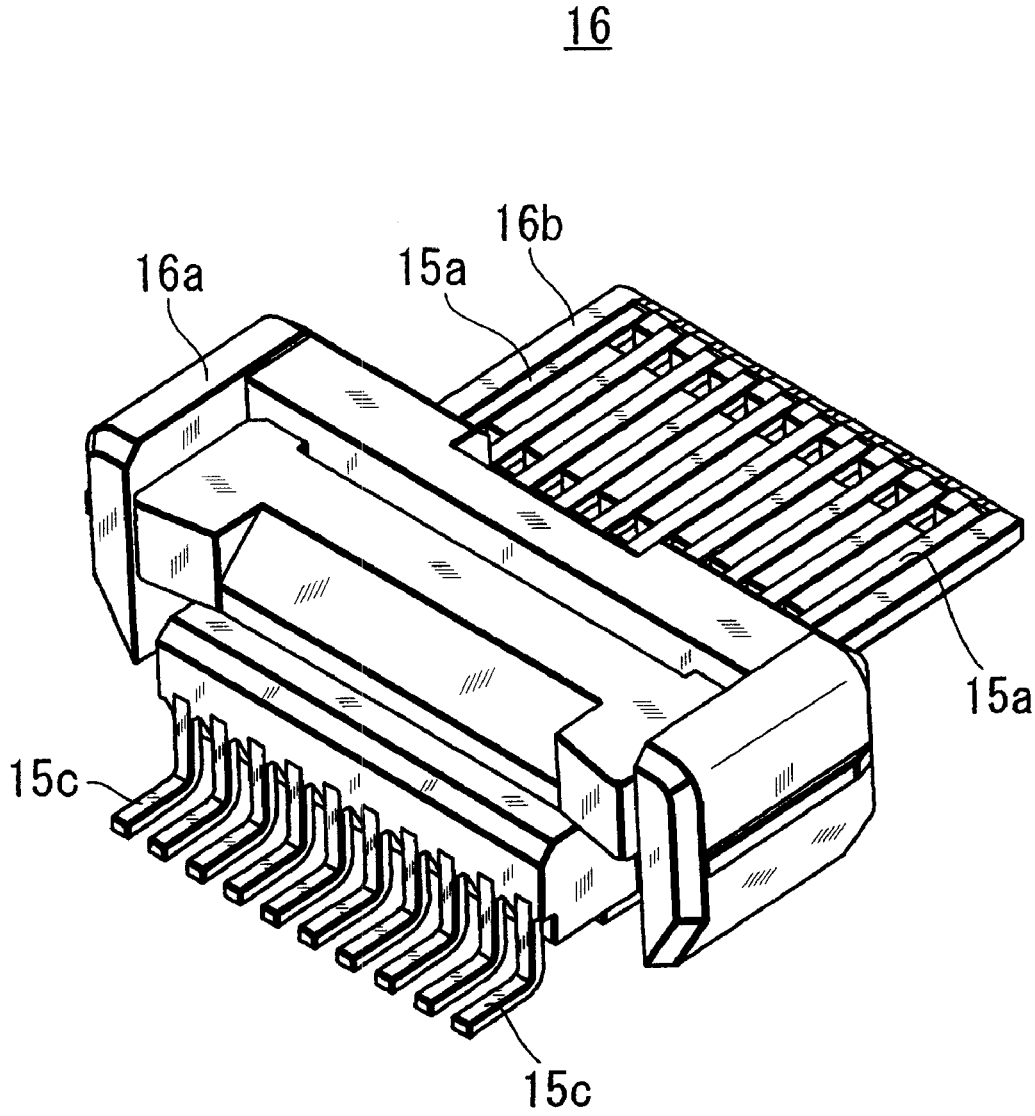
FIG. 9 is a perspective view of the body of the board mounted connector shown in FIG. 7.

Next, the board mounted connector 4 which is the counter connector for the above-described cable-side connector 2 will be described with reference to FIGS. 7 to 9. FIG. 7 is an external view of the board mounted connector 4 of the embodiment of the invention, FIG. 7A is a front view of the board mounted connector 4, FIG. 7B is a plan view of the board mounted connector 4, FIG. 7C is a bottom view of the board mounted connector 4, and FIG. 7D is a left side view of the board mounted connector 4. FIG. 8 is a sectional view of the board mounted connector 4 shown in FIG. 7B, taken along Y2-Y2. FIG. 9 is a perspective view of the body 16 of the board mounted connector 4 shown in FIG. 7B, as viewed from an upper oblique side.

As shown in FIGS. 7A to 7D, the board mounted connector 4 has a fitting portion 14 which is a connecting portion with respect to the cable-side connector 2. The dash-dot chain line 4*a* in FIGS. 7A to 7C indicates the center line of the fitting portion 14, i.e., the center line of the board mounted connector 4.

As shown also in FIGS. 8 and 9, the board mounted connector 4 is configured by nineteen contacts 15 which are counter contacts with respect to the contacts 7 of the cable-side connector 2, the body 16, and a shell 17, Each of the contacts 15 is configured by an L-like electrode terminal which is formed by applying a pressing process such as a punching process and a bending process on a metal plate, and is electrically conductive. In the contact 15, a stationary contact portion 15*a* which is elongated in the anteroposterior direction, a fixed portion 15*b* which is downward elongated from a rear end portion of the stationary contact portion 15*a*, and a soldering portion 15*c* which is rearward elongated from a lower end portion of the fixed portion 15*b* are formed.

The body 16 is made of an insulating material such as plastic, and is electrically insulative. In the body 16, a parallelepiped-like contact support basal portion 16*a*, and a rectangular plate-like contact support portion 16*b* which is projected from the middle of the front face of the contact support basal portion 16*a* in the forward direction (opposite to the direction along which the cable-side connector 2 is inserted to the board mounted connector 4) are formed.

In ten of the nineteen contacts 15, the fixed portions 15*b* are fixed to the contact support basal portion 16*a*, the stationary contact portions 15*a* are fixed in parallel in the anteroposterior direction while being laterally arranged in one row on the upper surface of the contact support portion 16*b*, and the soldering portions 15*c* are attached and held onto the body 16 in a state where the soldering portions 15*c* are projected to the lower side of a rear portion of the contact support basal portion 16*a*.

In the remaining nine contacts 15, the fixed portions 15*b* are fixed to the contact support basal portion 16*a*, the stationary contact portions 15*a* are fixed in parallel in the anteroposterior direction while being laterally arranged in one row on the lower surface of the contact support portion 16*b*, and the soldering portions 15*c* are attached and held onto the body 16 in a state where the soldering portions are projected to the lower side of a front portion of the contact support basal portion 16*a*.

In this way, the nineteen contacts 15 are attached and held to the body 16, arranged in the two upper and lower rows, and arranged in a zigzag manner so that the upper contacts 15 do not overlap with the lower contacts 15 in a plan view.

The shell 17 is configured by a rectangular metal-made tube which is formed by applying a pressing process such as a punching process and a bending process on a single metal plate, and which is elongated in the anteroposterior direction, and is electrically conductive. The rectangular tubular shape of the shell 17 is formed by joining the right and left edges of a punched metal plate (the shell 17 in a development state) to each other in the lower side of the shell 17, with being centered at the center line 4*a* of the shell 17. In the shell 17 having a rectangular tubular shape, therefore, the lower side plate is formed by the right and left end portions of the punched metal plate, and a seam joint 17*a* between the right and left end portions of the punched metal plate is disposed in the lower side plate of the shell 17, and centered at the center line 4*a* of the shell 17. The shape of the seam joint 17*a* is not linear, but formed into a convex and concave shape in which inverted trapezoidal convex concave portions are alternately continuous to one another.

Then, the body 16 to which the nineteen contacts 15 are attached and held is internally fitted to the shell 17, the outer surface (excluding the lower face) of the contact support basal portion 16*a* of the body 16 is covered by a rear portion of the shell 17, and the circumference of the contact support portion 16*b* is surrounded by a front portion of the shell 17. In the shell 17, the rear opening is closed by the contact support basal portion 16*a* of the body 16, and the front face is opened.

In this way, the fitting portion 14 of the board mounted connector 4 is configured by the shell 17 that surrounds the circumference of the contact support portion 16*b* of the body 16 on which the stationary contact portions 15*a* of the nineteen contacts 15 are arranged, that is made of a metal, and that has a shielding property. In the fitting portion 14, therefore, the seam joint 17*a* of the shell 17 is disposed in the lower surface, and centered at the center line 4*a* of the fitting portion 14.

In order to enhance the pull-out force required to pull the cable-side connector 2 out of the board mounted connector 4 to improve the fitting reliability of the multipolar connector, a projection 17*b* is disposed which functions as an engagement portion corresponding to one of the cutaway windows 9*b* of the cable-side connector 2, and which functions also as a pressing portion for causing the shell 9 of the cable-side connector 2 and the shell 17 of the board mounted connector 4 to be surely electrically contacted with each other, thereby improving the shielding property of the multipolar connector. The projection 17*b* is formed by a free end portion of a cantilevered plate spring piece 17*c* which is formed by partially cutting and raising the upper side plate of the shell 17. The plate spring piece 17*c* is elongated in the anteroposterior direction while the rear end is set as a fixed end, and the front end is set as a free end. A front end portion of the piece is bent to form the mountain-like projection 17*b* which is downward projected from an inner upper portion of the shell 17. The projection 17*b* and the plate spring piece 17*c* are disposed in two places which are bilaterally symmetric while setting the center line 4*a* of the shell 17 as the axis of symmetry. In the fitting portion 14, therefore, the projections 17*b* which are engagement portions and pressing portions with respect the cable-side connector 2 are disposed on the inner upper surface of the portion, and in the two places which are bilaterally symmetric while setting the center line 4*a* of the fitting portion 14 as the axis of symmetry.

A grounding terminal 17*d* which functions as a mounting terminal with respect to the board 3 is disposed in the shell 17. The grounding terminal 17*d* is downward projected from a total of four places, i.e., middle and rear end portions of right and left side portions of the shell 17. The two front and rear grounding terminals 17*d* of the left side are formed by extending portions of the left side plate of the shell 17, and the two front and rear grounding terminals 17*d* of the right side are formed by extending portions of the right side plate of the shell 17.

As shown in FIGS. 10 to 14, the thus configured board mounted connector 4 is mounted on an edge portion of the board 3. In this mounting, the four grounding terminals 17*d* are inserted and soldered to four grounding through holes 3*a* disposed in the board 3. Moreover, the soldering portions of all the contacts 15 are soldered to land portions (not shown) of the board 3 which are arranged in two front and rear rows in a zigzag manner.

Figure 10:
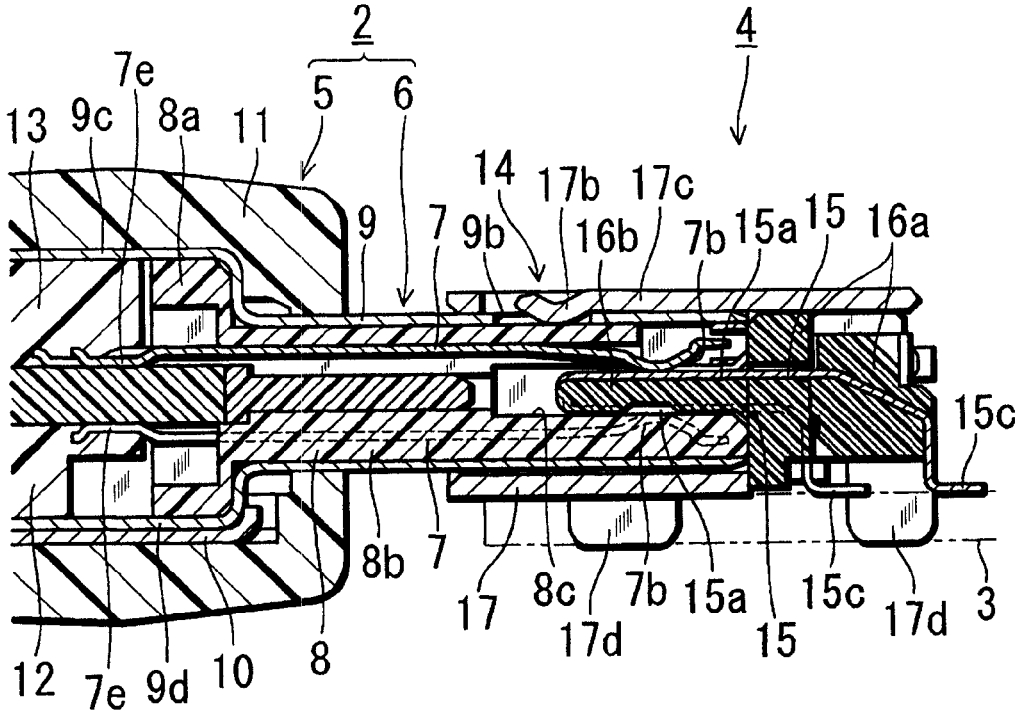
FIG. 10 is a sectional view of a fitting state of a multipolar connector of the embodiment of the invention.

Next, the function of the multipolar connector which is configured by the cable-side connector 2 and board mounted connector 4 that are described above will be described with reference to FIGS. 10 to 14. FIG. 10 is a sectional view of the multipolar connector in a state where the cable-side connector 2 is fitted to the board mounted connector 4, FIG. 11 is a perspective view of the multipolar connector as viewed from an obliquely upper side, in a state before the cable-side connector 2 is fitted to the board mounted connector 4, FIG. 12 is a perspective view of the multipolar connector as viewed from an obliquely upper side, in the state where the cable-side connector 2 is fitted to the board mounted connector 4, FIG. 13 is a perspective view as viewed from an obliquely upper side, in a state where the multipolar connector in which the cable-side connector 2 has not yet been fitted to the board mounted connector 4 is turned upside down, and FIG. 14 is a perspective view as viewed from an obliquely upper side, in a state where the multipolar connector in which the cable-side connector 2 is fitted to the board mounted connector 4 is turned upside down.

Figure 11:
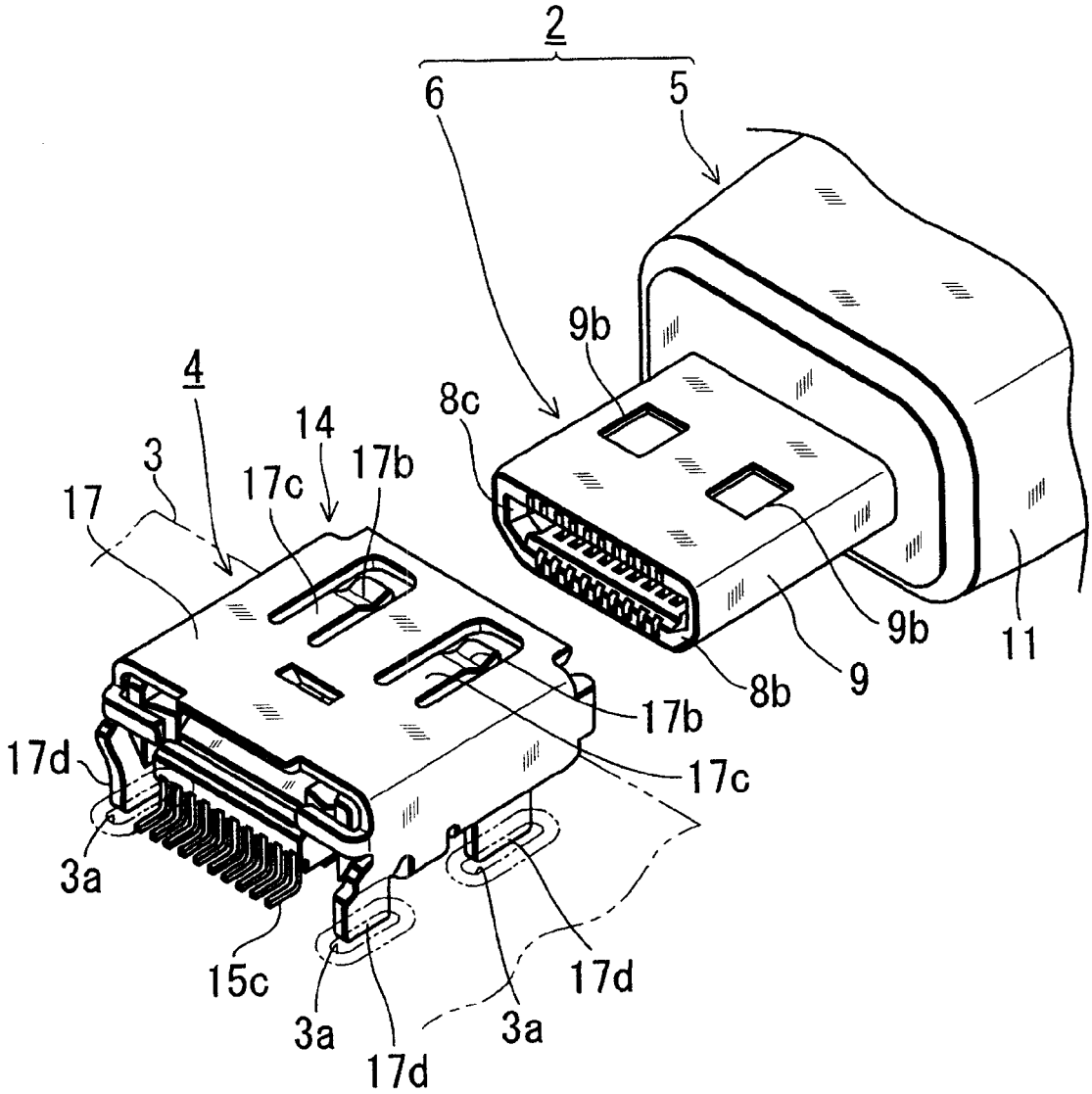
FIG. 11 is a perspective view of the upper face side of the multipolar connector shown in FIG. 10 before the multipolar connector is fitted.
Figure 12:
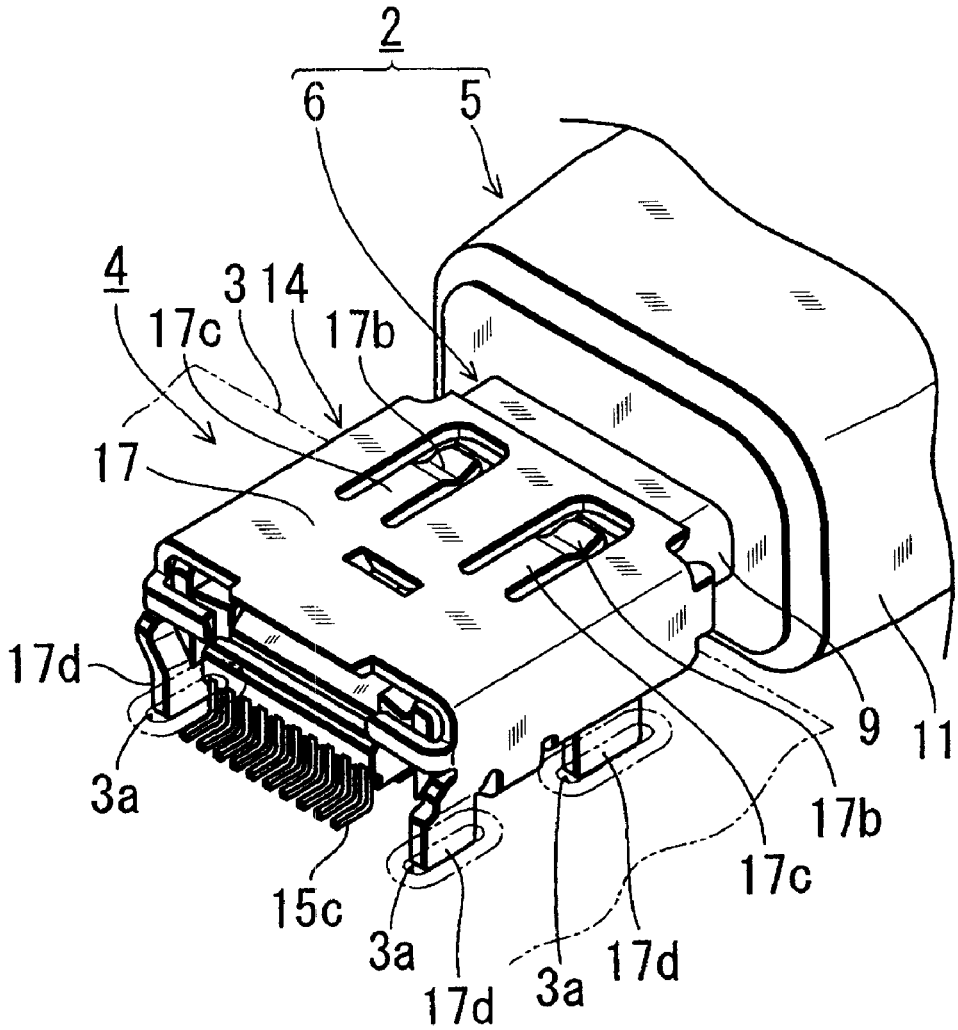
FIG. 12 is a perspective view of the upper face side of the multipolar connector shown in FIG. 10 in a state where the multipolar connector is fitted.
Figure 13:
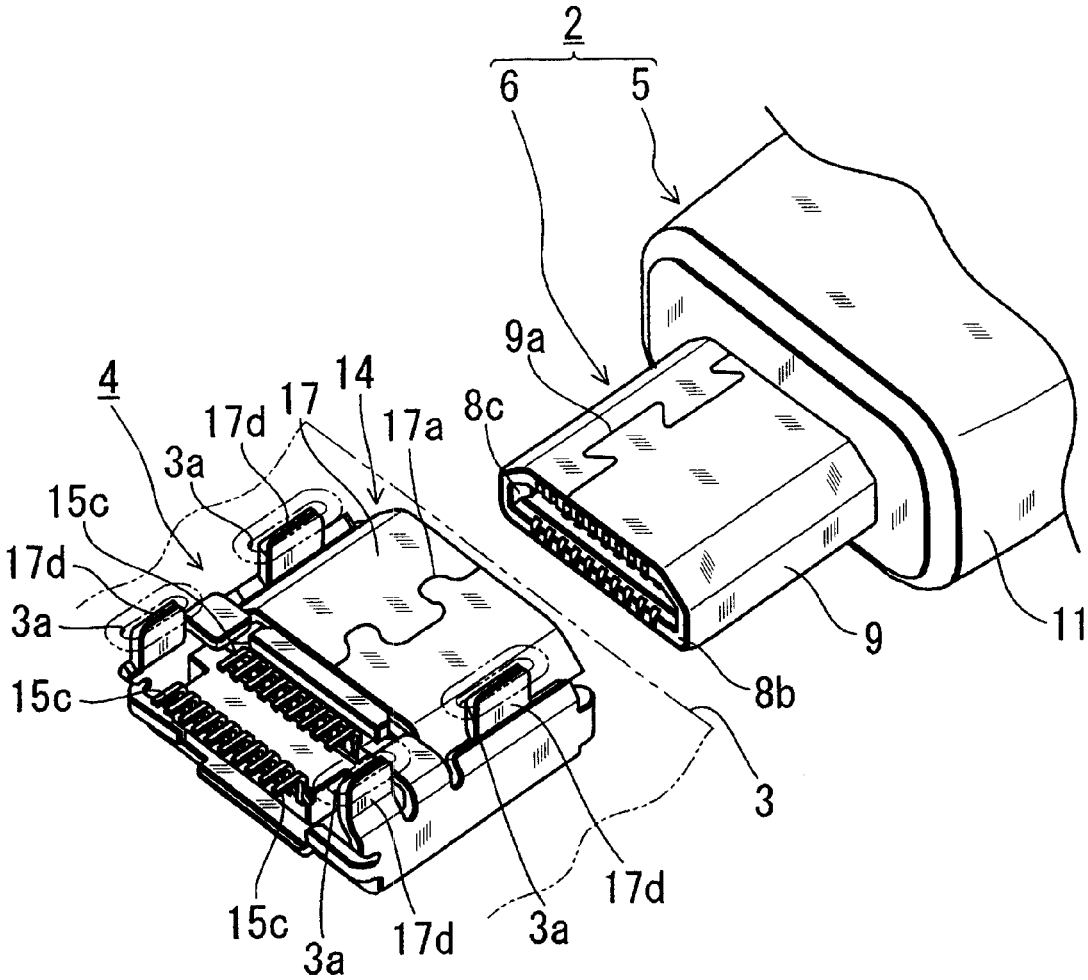
FIG. 13 is a perspective view of the lower face side of the multipolar connector shown in FIG. 10 before the multipolar connector is fitted.
Figure 14:
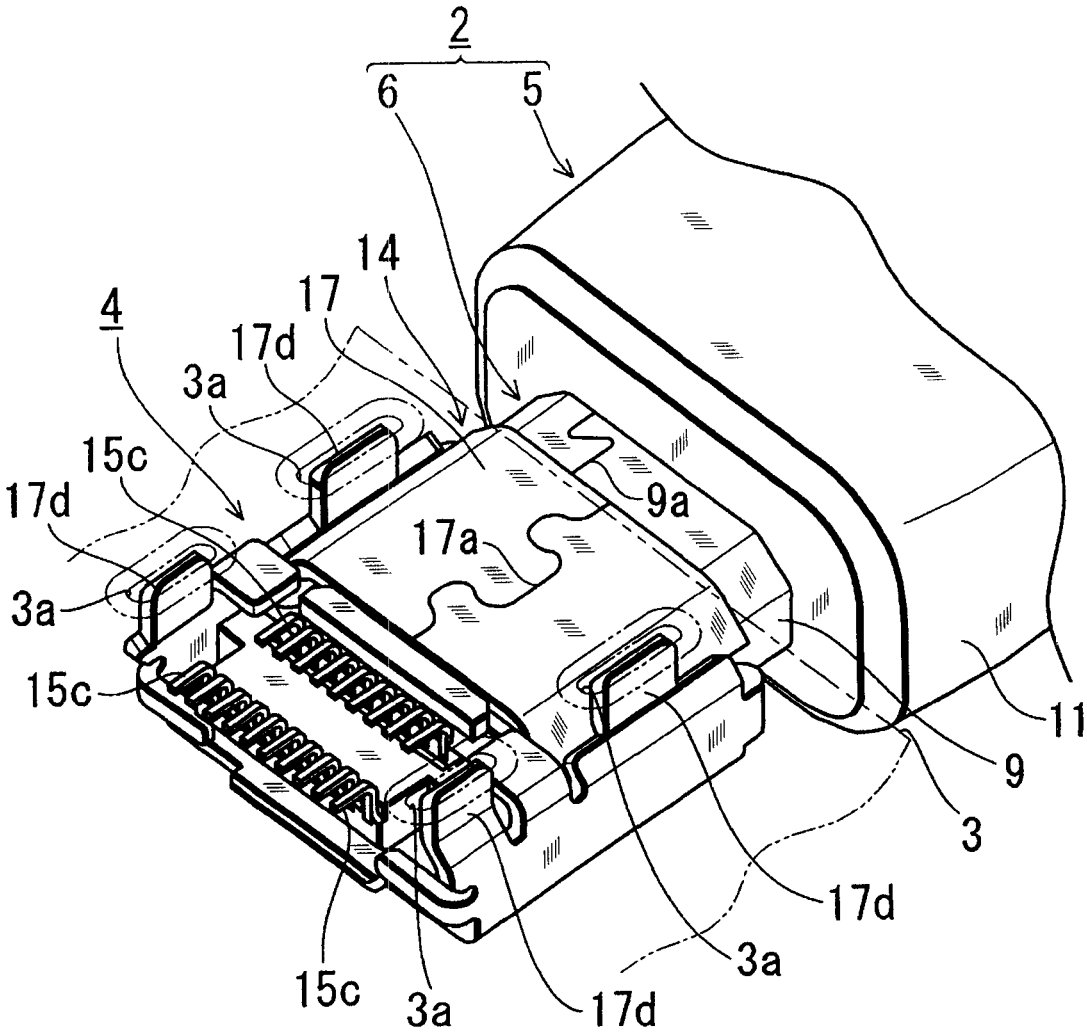
FIG. 14 is a perspective view of the lower face side of the multipolar connector shown in FIG. 10 in a state where the multipolar connector is fitted.

As shown in FIGS. 11 and 13, when the cable-side connector 2 is to be fitted to the board mounted connector 4, in a state where the connecting portion 5 of the cable-side connector 2 is held and the fitting portion 6 of the cable-side connector 2 is butted against the fitting portion 14 of the board mounted connector 4, the fitting portion 6 of the cable-side connector 2 is inserted and fitted into the fitting portion 14 of the board mounted connector 4. As a result of this insertion and fitting, the contact support portion 16*b* of the board mounted connector 4 and the stationary contact portions 15*a* of contact 15 which are arranged on the upper and lower surfaces of the contact support portion are inserted into the counter contact insertion hole 8*c* of the cable-side connector 2, the movable contact portions 7*b* of the upper contacts 7 which are projected and held in the upper portion of the counter contact insertion hole 8*c* of the cable-side connector 2 are pressingly contacted with the stationary contact portions 15*a* of the upper contacts 15 which are arranged on the upper surface of the contact support portion 16*b*, and the movable contact portions 7*b* of the lower contacts 7 which are projected and held in the lower portion of the counter contact insertion hole 8*c* of the cable-side connector 2 are pressingly contacted with the stationary contact portions 15*a* of the lower contacts 15 which are arranged on the lower surface of the contact support portion 16*b*. As shown in FIGS. 10, 12, and 14, therefore, the cable 1 is connected to the board 3 physically and electrically through the cable-side connector 2 and the board mounted connector 4.

In accordance with the insertion and fitting of the fitting portion 6 of the cable-side connector 2 to the fitting portion 14 of the board mounted connector 4, the right and left projections 17*b* disposed on the inner upper surface of the fitting portion 14 of the board mounted connector 4 override the upper surface of the fitting portion 6 of the cable-side connector 2, in a state where the plate spring piece 17*c* is upward flexed. In accordance with the complete fitting of the fitting portion 6 of the cable-side connector 2 to the fitting portion 14 of the board mounted connector 4, the right and left cutaway windows 9*b* disposed on the upper surface of the fitting portion 6 of the cable-side connector 2 coincide with the right and left projections 17*b*, and the right and left projections 17*b* are engaged and held to the right and left cutaway windows 9*b* by the urging forces of the plate spring pieces 17*c*. Therefore, the pull-out force required to pull the cable-side connector 2 out of the board mounted connector 4 is enhanced, and the fitting reliability of the multipolar connector is improved.

When the right and left projections 17*b* are fitted to the right and left cutaway windows 9*b*, the projections butt against the upper surface of the contact support portion 8*b* of the cable-side connector 2 to downward press the cable-side connector 2 by the urging forces of the plate spring pieces 17*c*. Therefore, the lower surface of the shell 9 of the cable-side connector 2 is pressingly contacted with the inner lower surface of the shell 17 of the board mounted connector 4, and the shells 9, 17 of the cable-side connector 2 and the board mounted connector 4 are surely electrically contacted with each other. Furthermore, the shield (the shell 9 and the back shell) of the cable-side connector 2 and the cable shield 1*a* are surely electrically contacted with each other. As a result, the cable shield 1*a*, the shield (the shell 9 and the back shell) of the cable-side connector 2, the shield (the shell 17) of the board mounted connector 4, the shield (the ground) of the board 3 are closely coupled to one another to configure a shield having excellent EMI characteristics.

The right and left cutaway windows 9*b* of the cable-side connector 2 are disposed in the two places which are bilaterally symmetric while setting the center line 2*a* of the fitting portion 6 as the axis of symmetry. When a pull-out force is applied to the cable-side connector 2, therefore, it is possible to prevent the cable-side connector 2 from being inclined to cause prying. In the case where the right and left cutaway windows 9*b* of the cable-side connector 2 are disposed in the two places which are asymmetric about the center line 2*a* of the fitting portion 6, when a pull-out force is applied to the cable-side connector 2, by contrast, the cable-side connector 2 is inclined to cause prying.

In the board mounted connector 4, the right and left projections 17*b* and the plate spring pieces 17*c* are formed on the side opposite to the board 3 of the shell 17, i.e., the upper side plate of the shell 17. Therefore, a countermeasure against high-frequency noises which may leak from cutaway grooves for forming the right and left projections 17*b* and the plate spring pieces 17*c* can be easily taken by using the case of an apparatus, an EMI suppressing sheet, or the like. In the case where the right and left projections 17*b* and the plate spring pieces 17*c* are formed on the side of the board 3 of the shell 17, by contrast, the case of an apparatus, an EMI suppressing sheet, or the like cannot be used as a countermeasure against high-frequency noises which may leak from cutaway grooves for forming the right and left projections 17*b* and the plate spring pieces 17*c*, and hence the countermeasure is hardly realized.

In the cable-side connector 2, the seam joint 9*a* of the shell 9 is disposed in the face (the upper side plate) opposite to the one face (the lower side plate) of the shell 9 where the cutaway windows 9*b* are disposed. Therefore, it is possible to easily cope with miniaturization of the multipolar connector, and, when a pull-out force is applied to the cable-side connector 2, it is possible to prevent the seam joint 9*a* of the shell 9 from being opened by the pull-out force. In the case where the seam joint 9*a* of the shell 9 and the cutaway windows 9*b* are disposed in the same face of the shell 9, by contrast, it is difficult to cope with miniaturization of the multipolar connector, and, when a pull-out force is applied to the cable-side connector 2, the seam joint 9*a* of the shell 9 is opened by the pull-out force.

In the board mounted connector 4, the seam joint 17*a* of the shell 17 is disposed with being centered at the center line 4*a* of the shell 17. In the shell 17, therefore, the right and left prying strengths caused by the cable-side connector 2 can be balanced with each other, and the prying resistance of the board mounted connector 4 is not reduced but can be improved. In the case where the seam joint 17*a* of the shell 17 is disposed with being biased from the center line 4*a* of the shell 17, by contrast, the right and left prying strengths in the shell 17 caused by the cable-side connector 2 are made different from each other, and hence the prying resistance of the board mounted connector 4 is largely impaired.

From the above, the configuration where the cutaway windows 9*b* of the cable-side connector 2, and the projections 17*b* and plate spring pieces 17*c* of the board mounted connector 4 are disposed in the upper side plates (opposite to the substrate 3) of the shells 9, 17, that where the cutaway windows 9*b*, and the projections 17*b* and the plate spring pieces 17*c* are disposed in the two places which are bilaterally symmetric while setting the center lines 2*a*, 4*a* of the shells 9, 17 as the axis of symmetry, that where the seam joints 9*a*, 17*a* of the shells 9, 17 of the cable-side connector 2 and the board mounted connector 4 are disposed in the lower side plates (on the side of the board 3) of the shells 9, 17, and that where the seam joint 17*a* of the shell 17 of the board mounted connector 4 is disposed with being centered at the center line 4*a* of the shell 17 are effective.

In the case where the seam joint 9*a* of the shell 9 of the cable-side connector 2 is disposed with being centered at the center line 2*a* of the shell 9, when the cable-side connector 2 is fitted to the board mounted connector 4, there is a possibility that the seam joint 9*a* of the shell 9 of the cable-side connector 2 coincides with the seam joint 17*a* of the shell 17 of the board mounted connector 4 and high-frequency noises leak through gaps of the coincident seam joints 9*a*, 17*a*, thereby causing a problem in countermeasure against EMI. As shown in FIG. 13, the seam joint 9*a* of the shell 9 of the cable-side connector 2 is disposed in a position which is biased toward the right side from the center line 2*a* of the shell 9. When the cable-side connector 2 is fitted to the board mounted connector 4, therefore, the seam joint 9*a* of the shell 9 of the cable-side connector 2 is shifted from the seam joint 17*a* of the shell 17 of the board mounted connector 4 as shown in FIG. 14. Consequently, high-frequency noises hardly leak, and the EMI characteristics of the multipolar connector can be improved.

In the cable-side connector 2, as shown in FIG. 6, the seam joint 9*a* of the shell 9 is disposed outside the region where the four contact pairs for transmitting high-speed differential signals are arranged. Therefore, the seam joint 9*a* of the shell 9 is shifted from the line for transmitting high-speed differential signals (the contact pairs of the cable-side connector 2 and the board mounted connector 4). Consequently, high-frequency noises more hardly leak, and the EMI characteristics of the multipolar connector can be further improved. The seam joint 9*a* of the shell 9 may not have a linear shape, but have a convex and concave shape having a width, and, in accordance with miniaturization of a multipolar connector, a part of the seam joint may overlap with the line for transmitting high-speed differential signals. When the most of the width of the convex and concave shape does not overlap with the line for transmitting high-speed differential signals, however, it is possible to achieve the effect that leakage of high-frequency noises is reduced.

Although the embodiment has been described with reference to a multipolar connector for connecting a cable for a high-speed interface through which electric/electronic apparatuses are connected with each other, with an electric/electronic apparatus, the invention is not limited thereto, and may be variously modified without departing the spirit of the invention.

DESCRIPTION OF REFERENCE NUMERALS

1 cable
1*a* cable shield
2 cable-side connector (multipolar plug)

2*a* center line of cable-side connector
4 board mounted connector (counter connector)
6 fitting portion
7 contact
8 body
9 shell
9*a* seam joint
9*b* cutaway window (engagement portion)
9*c* back shell body
10 back shell cover

What is claimed is:

1. A multipolar plug in which a tubular shell that is a cover for a circumference of a fitting portion for a counter connector is formed by applying a bending process on a metal plate, thereby providing said shell with a shielding property, and said shell has a seam joint, wherein said seam joint is disposed in a position which is biased to one side of a center line of said shell, a plurality of contacts which are attached to a body made of an insulating material, said plurality of contacts being surrounded by said shell and including a plurality of contact pairs for transmitting high-speed differential signals, all of said plurality of contact pairs being disposed in a contact pair region of said shell, said shell including a non-contact pair region that is disposed adjacent to said contact pair region, and wherein said seam joint is disposed at a location within said non-contact pair region and spaced from said contact pair region so that leakage of high frequency noise produced by the plurality of contact pairs via a qap in said seam joint is reduced.

2. A multipolar plug according to claim 1, wherein a tubular back shell that is a cover for a portion to which a cable is to be connected is disposed, said back shell is formed by a metal plate, thereby providing said shell with a shielding property, and said shell, said back shell, and a shield of said cable are electrically coupled to one another.

3. A multipolar plug in which a tubular shell that is a cover for a circumference of a fitting portion for a counter connector is formed by applying a bending process on a metal plate, thereby providing said shell with a shielding property, and said shell has a seam joint, wherein said seam joint is disposed in a position which is biased to one side of a center line of said shell, an engagement portion for the counter connector is formed in one face of said shell, said seam joint is disposed in a face opposite to the one face of said shell in which said engagement portion is formed, a plurality of contacts which are attached to a body made of an insulating material, and said plurality of contacts being surrounded by said shell and including a plurality of contact pairs for transmitting high-speed differential signals, all of said plurality of contact pairs being disposed in a contact pair region of said shell, said shell including a non-contact pair region that is disposed adjacent to said contact pair region, and wherein said seam joint is disposed at a location within said non-contact pair region and spaced from said contact pair region so that leakage of high frequency noise produced by the plurality of contact pairs via a qap in said seam joint is reduced.

4. A multipolar plug according to claim 3, wherein a tubular back shell that is a cover for a portion to which a cable is to be connected is disposed, said back shell is formed by a metal plate, thereby providing said shell with a shielding property, and said shell, said back shell, and a shield of said cable are electrically coupled to one another.

* * * * *